US005366284A

United States Patent [19]

Baker et al.

[11] Patent Number: 5,366,284

[45] Date of Patent: Nov. 22, 1994

[54] REFRIGERATOR STORAGE COMPARTMENT WITH SLIDE BEARING SYSTEM

[75] Inventors: Phillip D. Baker, Morgantown, N.C.; John T. Ulmer, Jeffersontown, Ky.; Claude L. Blake, Lanesville, Ind.

[73] Assignee: General Electric Company, Louisville, Ky.

[21] Appl. No.: 972,636

[22] Filed: Nov. 6, 1992

[51] Int. Cl.[5] ..... A47B 81/00

[52] U.S. Cl. ..... 312/404; 312/330.1; 312/334.7

[58] Field of Search ..... 312/404, 408, 410, 330.1, 312/334.7, 334.1, 334.8, 334.16

[56] References Cited

U.S. PATENT DOCUMENTS

| | | | |
|---|---|---|---|
| 2,517,725 | 8/1950 | Schweller | 312/404 X |
| 2,759,773 | 8/1956 | Wilmer et al. | 312/334.16 |
| 3,456,996 | 7/1969 | Heiniger-Schar | 312/330.1 X |
| 4,334,715 | 6/1982 | Schreiner | 312/330.1 X |
| 4,936,641 | 6/1990 | Bussan et al. | 312/408 |
| 5,040,856 | 8/1991 | Wilkins et al. | 312/214 |
| 5,065,920 | 11/1991 | Amner | 312/334.7 X |

*Primary Examiner*—Timothy V. Eley
*Assistant Examiner*—Khan V. Nguyen
*Attorney, Agent, or Firm*—H. Neil Houser

[57] ABSTRACT

A refrigerator storage drawer system includes a drawer having side walls with upper ledges terminating in downwardly projecting lips. Spaced apart support structures support the lips for sliding movement of the drawer. Each support includes a pair of slide type support bearings spaced apart along the support. The bearings on one side of the drawer closely interfit with the drawer to provide smooth, non-binding operation of the drawer. The bearings on the other side of the drawer provide wide slide bearing surfaces which accommodate tolerance build-up in the system. An additional bearing is positioned on the support structure above the drawer ledge, forward of the rear one of the support bearings and engages the drawer ledge if the drawer tends to tilt downwardly as it is pulled out of the refrigerator.

8 Claims, 2 Drawing Sheets fig. 2
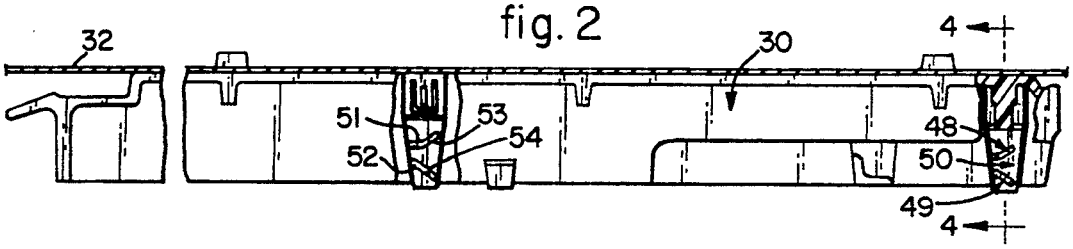
fig. 3
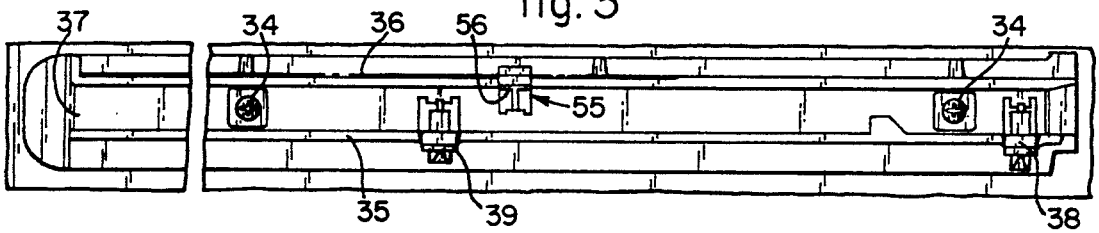
fig. 4
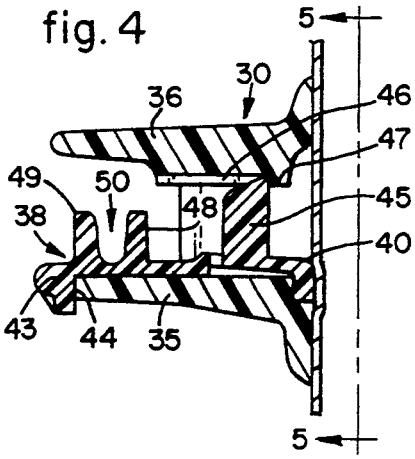
fig. 5
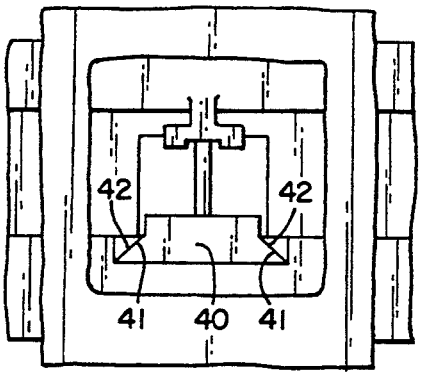
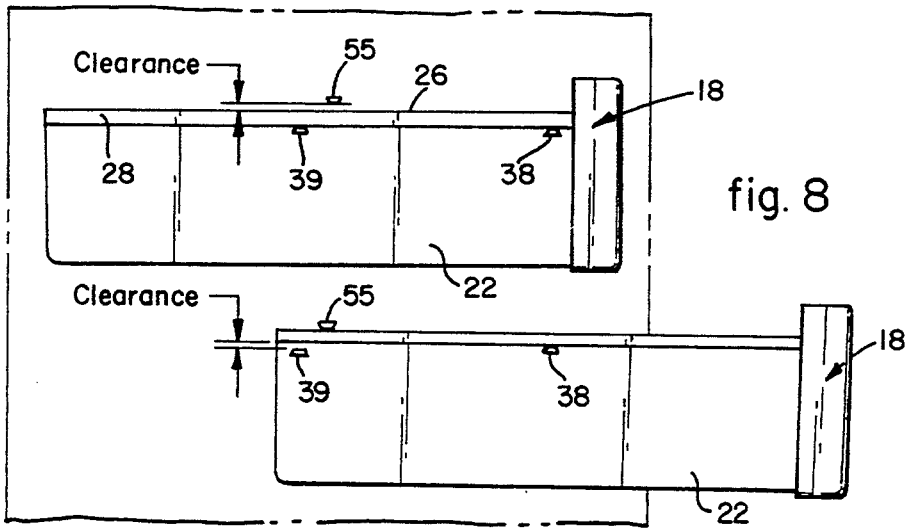
fig. 8

REFRIGERATOR STORAGE COMPARTMENT WITH SLIDE BEARING SYSTEM

BACKGROUND OF THE INVENTION

Modern refrigerators often include moveable drawers to store meats, vegetables and other items which need a slightly different environment than that provided by the fresh food compartment. In the past several years such drawers have come to be molded from suitable plastic materials and their side walls typically are thin enough that they are somewhat flexible. In addition, as refrigerators get larger the side to side dimension becomes larger and the tolerances become larger. This creates problems for mounting drawers, particularly those that extend completely across a refrigerator. The drawer must have a width appropriate to prevent interference with its support structure when the tolerances are all toward a smaller clearance. As the tolerances accumulate in the other direction, as they will from time to time, the drawer has excessive side-to-side free play on its supporting structure and can wobble. If the user moves the drawer in or out of the refrigerator in an off-center manner, as by grasping the drawer away from its center or by applying force other than parallel to the drawer mounting, the drawer will tend to twist or cock and bind in its support structure. In a severe case the user must strike the drawer a sharp blow to dislodge it. In any event the wobble conveys to the user an impression of poor quality.

U.S. Pat. No. 5,040,856 incorporates a system with rollers on both the drawer and the support structure. The mating tracks on one side of the drawer fit closely around the rollers while the tracks on the other side are wider. Such a system is complicated and expensive, both in part cost and in assembly time.

It is an object of this invention to provide an improved refrigerator storage system in which the drawer is supported for smooth straight non-binding movement into and out of the refrigerator while, at the same time lateral tolerances are accommodated.

It is another object of this invention to provide such a system which incorporates slide type support bearings.

It is still another object of this invention to provide such a compartment in which the support bearings on one side of the drawer interact with the drawer side to position and guide the drawer while the support bearings on the other side of the drawer accommodate lateral tolerance variations.

Other advantages of the invention will become apparent and a fuller understanding of its mode of construction and method of operation will be gained from the following detailed description of preferred embodiments, taken in conjunction with the accompanying drawings.

BRIEF DESCRIPTION OF THE DRAWINGS

FIG. 2 is a top plan view of a drawer support structure of the refrigerator of FIG. 1, partially broken away and partly in section for purposes of illustration;

FIG. 3 is a side elevation view of the support structure of FIG. 2;

FIG. 4 is a fragmentary cross-section view as seen along line 4—4 in FIG. 2, illustrating certain details of a support bearing and its mounting in the support structure;

FIG. 5 is a fragmentary elevation view as seen along line 5—5 in FIG. 4, illustrating additional details of the bearing and mount;

FIG. 8 is a schematic side elevational view illustrating the relationship between a drawer, a rear support bearing and an upper bearing.

DESCRIPTION OF THE PREFERRED EMBODIMENTS

Figure 1:
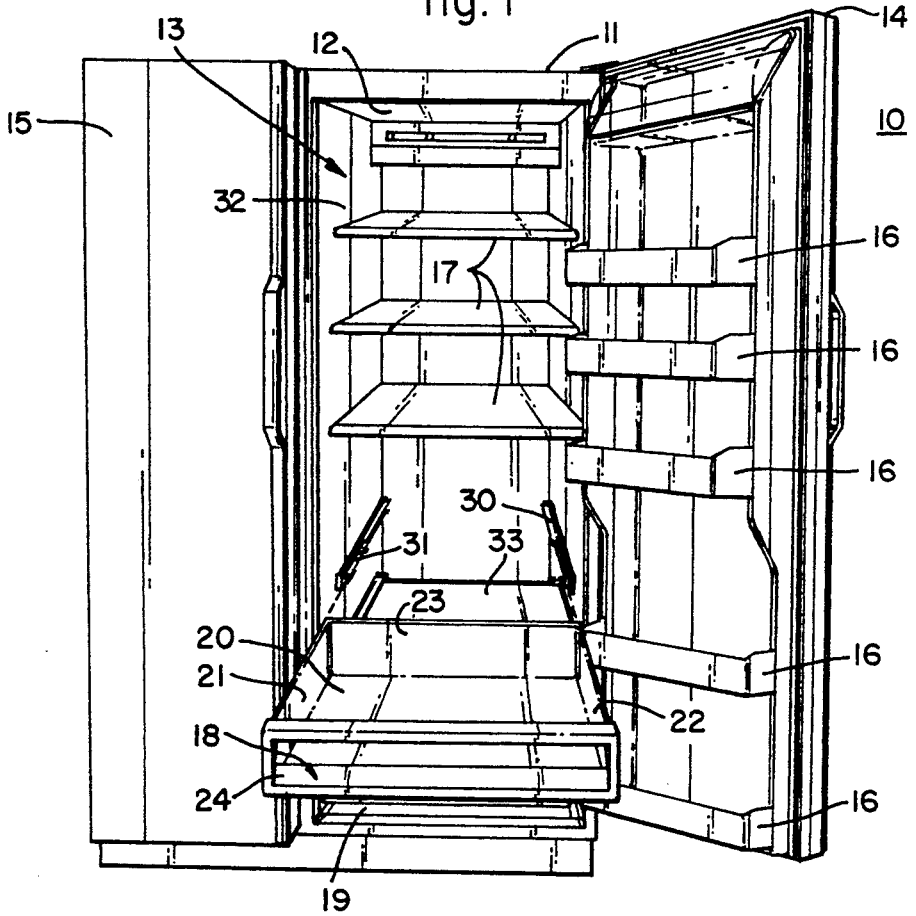
FIG. 1 is a front perspective view of a side-by-side refrigerator/freezer type of refrigerator, with the fresh food compartment door open to illustrate various internal components.
Figure 7:
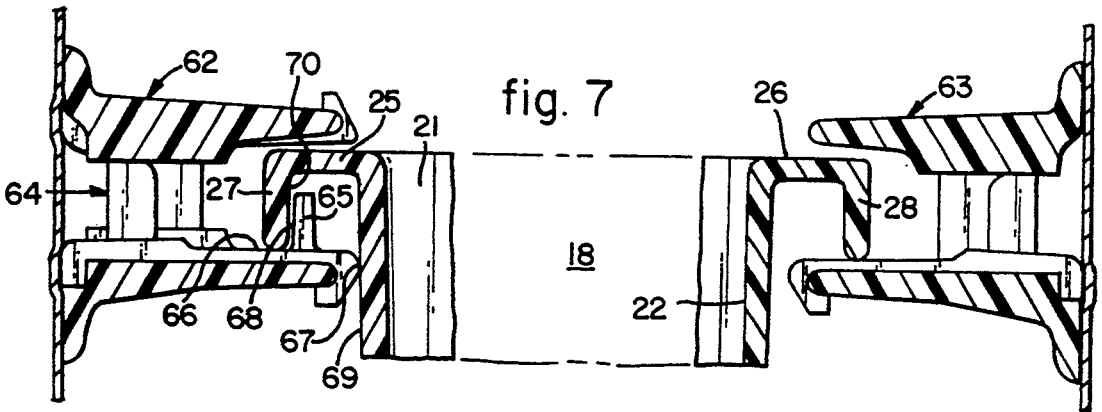
FIG. 7 is a view similar to FIG. 6 but illustrating a drawer mounted in support structures with support bearings of a somewhat different design.
Figure 6:
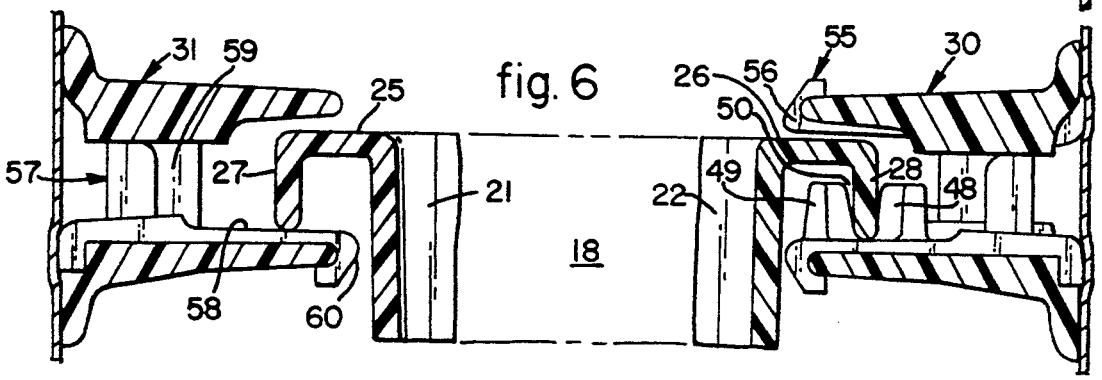
FIG. 6 is a fragmentary, schematic cross-section view of a drawer mounted in support structures as seen in FIGS. 1-5.

Referring now to the drawings and particularly to FIG. 1, there is shown a side-by-side refrigerator 10 having an outer cabinet 11 containing a freezer compartment (not shown) and a fresh food compartment 12 separated by an internal wall 13. Access to the fresh food compartment and freezer compartment is provided by a fresh food door 14 and a freezer door 15 respectively. Conveniently the door 14 includes a number of movable shelves or bins 16 and the upper portion of the fresh food compartment includes moveable storage shelves 17. Often one or more closed drawers are provided in the bottom portion of the fresh food compartment to store items requiring a more controlled atmosphere than is present in the remainder of the fresh food compartment. These drawers, such as those shown at 18 and 19, may be pulled out of the refrigerator for access and pushed fully into the fresh food compartment so as to be sealed against uncontrolled air flow. Conveniently the drawers are formed in an open top pan configuration with a bottom wall 20 and generally vertical side walls 21 and 22 , and rear wall 23. A front wall structure 24 completes the periphery of the drawer and includes features such as handles and a viewing window. As illustrated in FIGS. 6 and 7 the tops of the side walls include outwardly projecting, horizontal ledges 25, 26, which terminate in downwardly projecting lips 27, 28.

Often at least one of these drawers will be wide enough to extend entirely across the fresh food compartment. Also they are often molded from a suitable strong and attractive plastic material such as a polycarbonate resin sold by General Electric Company under the name Lexan. In order to conserve material and to provide better visibility into the drawer the walls are relatively thin. This results in the drawer being somewhat flexible. In addition such drawers have a fairly large lateral tolerance, that is the width from the outside of one side wall to the outside of the other side wall may vary fairly significantly. In addition it is conventional to form the inner liner of such refrigerators by molding suitable plastic materials, or forming thin metal stock, resulting in similar large tolerances in the fresh food compartment lateral dimension. The insulation foamed in place between the outer case and the fresh food liner causes additional tolerances. For example it is not uncommon for large refrigerators to have a total lateral tolerance build-up of as much as $\frac{1}{8}$ to $\frac{1}{4}$ inch.

Stationary side support structures such as those shown at 30 and 31 are conveniently secured to the liner 32 forming the fresh food compartment and support the drawers for movement into and out of the compartment. Normally covers, such as that shown at 33 for drawer 19, rest on the support structures and close the open tops of the drawers when they are fully seated in the refrigerator.

In the event the tolerances build up in the direction to increase the clearance of the drawer the sliding movement of the drawer may have excessive wobble or side to side free play and convey to the user an impression of poor quality. Potentially more serious, if such a drawer is moved with a force that is not parallel to the path defined by the support structures, it may twist or cock on the supports and bind; that is one front corner and the opposite rear corner of the drawer may become "locked" across the liner. When this occurs it can be necessary to strike the drawer a sharp blow to free it. This is irritating to the user and may cause damage to one or more parts of the drawer, supports, liner or the contents of the refrigerator.

Referring now more particularly to FIGS. 2–6, inclusive, there is shown a drawer system in accordance with a preferred embodiment of the present invention which provides smooth straight and non-binding movement of the drawer and, at the same time accommodates wide variations in the build up of lateral tolerances. The side support 30 is mounted to the refrigerator liner 32 by any suitable means such as screws 34 so that it provides a stationary support for one side of the drawer 18. The structure 30 includes a lower support wall or rail 35 which projects laterally into the fresh food compartment and extends along its side; a top wall or rail 36 which overlies the lower rail and a vertical wall or web 37 which connects the rails and receives the mounting screws 34.

The lower rail is provided with slide type guide bearings, including preferably a front bearing 38 and an identical rear bearing 39. Slide bearings provide a stationary, low friction surface which supports a moving or sliding member. As best seen in FIGS. 4 and 5, the bearing 38 includes an outer tab 40 which is angled at 41 to interfit with mating angled cut outs 42 in rail 35. The inner end of bearing 38 is formed with a downwardly projecting nose 43 which fits over the distal edge 44 of rail 35. A finger 45 projects up from the tab 40 and fits into a recessed fixture 46 in the upper rail 36. The bearing 38 is mounted in the lower rail 35 by sliding it through an opening in the web 37 until the angled portions 41 are received in the mating cut outs in rail 35, the nose 43 fits over the distal 44 of rail 35 and the finger flexes around a lip 47 and snaps into the recess 46. In this way the bearing is securely, but removably mounted in the structure 30.

The guide bearing 38 includes a pair of spaced apart walls 48, 49 which form an upwardly open channel 50. More specifically the walls include rear portions 51, 52 which are generally parallel and front portions 53, 54 which diverge in the direction of the front of the refrigerator. When the drawer 18 is inserted into the refrigerator, the lip 28 is received in the channel 50. The forwardly divergent wall portions 53, 54 facilitate fitting the lip between the walls. The wall portions 51, 52, while generally parallel, diverge upwardly sufficiently to accommodate tolerances in the channel width and thickness of lip 28, which result principally from the draft required to remove them from their respective molds. Thus the channel walls 48, 49 fit closely adjacent the lip 28 to guide the drawer 18 for smooth straight and non-binding movement into and out of the refrigerator. The rear guide bearing 39 is identical to the front guide bearing 38 in structure, mounting and interaction with the lip 28.

An additional or upper bearing 55 is mounted in the upper wall or rail 36 at a position slightly forward of the rear guide bearing 39. The upper bearing is basically the same as the guide bearings in construction and mounting except that the walls 48, 49 are omitted so that the main body 56 of this bearing is smooth. Referring particularly to FIG. 8, the upper bearing is spaced slightly above the corresponding drawer ledge 26 when the drawer is fully inserted into the refrigerator and the lip 28 rests on guide bearings 38, 39. When the drawer is pulled outwardly the front of the drawer tends to tilt downwardly, as is illustrated in the lower portion of FIG. 8. Then the rear portion of lip 28 rises from the rear guide bearing 39 and ledge 26 abuts the upper bearing 55 and supports the drawer.

The other side support 31 is mounted to the opposite side wall of the refrigerator liner and is similar to support 30, except for the configuration of the bearings. As best seen in the left hand portion of FIG. 6, all of the bearings mounted to rail 31 are identical and are the same configuration as the upper bearing 55 of support 30. That is, the main body 58 is smooth and wide from the finger 59 to the nose 60. Conveniently the supports are molded from a strong plastic such as high impact polystyrene (HIPS) and the bearings are molded from a low friction material such as acetal. The support structures 30, 31 cooperate with the drawer 18 to assure smooth straight and non-binding movement of the drawer while accommodating significant variation in the lateral dimensions of the various components, such as the drawer and liner. To this end the only tolerances which affect the movement of the drawer are those associated with the thickness of lip 28 and the size of channel 50. On the other hand, the width of the main body 58 of bearings 57 provide a wide area of potential contact between lip 27 and those bearings, to accommodate variations in tolerances of the various components of the drawer system.

Referring now to FIG. 7, there is shown a drawer and support system incorporating another embodiment of the present invention . The support structures 62, 63 are the same in construction and interaction with the drawer 18, except for the configuration of the front and rear guide bearings, one of which is shown at 64. The guide bearings 64 are substantially the same as the guide bearings 38, 39 except that only one wall or dam 65 extends upwardly from main body 66, rather than the double walls 48, 49 of bearings 38, 39. The wall 65 is positioned so that the distance between nose tip 67 and the outer surface 68 of wall 65 is slightly less than the minimum distance between the outer surface 69 of drawer side wall 21 and the inner surface 70 of lip 27. Thus the wall 65 and nose tip 67 fit between the drawer side wall and the corresponding lip to assure smooth, straight and non-binding movement of the drawer. The lower or support bearings mounted on support structure 63, as well as the upper bearing mounted on support structure 62, conveniently may have the same construction as upper bearing 55 and support bearings 57. Thus the right support structure, as seen in FIG. 7, accommodates tolerance variations.

While the present invention has been described in connection with a drawer which extends the full width of the refrigerator compartment, it will be recognized that it also is applicable to drawers which extend only part way across the compartment.

We claim:

1. A storage drawer system in a refrigerator, comprising:

a drawer having opposed, generally vertical side walls, the upper portion of each of said side walls being formed with an outwardly projecting ledge terminating in a lip projecting downwardly generally parallel to the corresponding drawer side wall;

a pair of stationary support structures, each structure being mounted in the refrigerator and extending front to rear of said refrigerator adjacent to a corresponding drawer side wall and including an elongated support wall positioned below the corresponding drawer lip;

a plurality of support bearings mounted on each of said support structures in spaced apart relationship along its support wall, each of said support bearings projecting above the corresponding support wall to provide sliding support to the corresponding drawer lip, each of said plurality of support bearings including a front and a rear bearing;

said support bearings projecting above one of said support walls include open top channel structures closely receiving the corresponding drawer side wall lip for smooth, non-binding movement of said drawer along said support walls; and said support bearings projecting above the other of said support walls providing support surface for the lip of the corresponding drawer side wall, said support surfaces being wide in the direction perpendicular to the corresponding drawer side wall lip to accommodate dimensional tolerances of said drawer system.

2. A storage drawer system as set forth in claim 1, wherein:

each of said support structures also includes an upper wall positioned above the corresponding drawer ledge; and an additional bearing mounted on at least one of said support structures at a position on its upper wall slightly toward the front of the refrigerator with respect to the rear support bearing projecting above the corresponding support wall, said additional bearing projecting below the corresponding upper wall to engage the corresponding drawer ledge when the drawer is open.

3. A storage drawer system as set forth in claim 1, wherein: each of said support walls terminates in an inner edge positioned below the corresponding drawer ledge; each of said plurality of support bearings projecting above said one support wall includes a nose positioned inwardly of said inner edge of said one support wall and an upwardly projecting dam positioned outwardly of said nose; the spacing between said nose and said dam in a direction perpendicular to the corresponding drawer side wall being less than the distance between facing surfaces of the corresponding drawer side wall and its lip.

4. A storage drawer system as set forth in claim 1, wherein: each channel structure includes a pair of rear wall portions spaced apart slightly more than the thickness of said drawer lip and a pair of front wall portions which diverge in the direction of the front of said refrigerator.

5. A storage drawer system as set forth in claim 2, wherein: each of said support and additional bearings has a snap-action interference mounting to its corresponding support structure.

6. A storage drawer system as set forth in claim 5, wherein: said support structures are formed of a strong plastic material and said bearings are separately formed of a slide bearing material.

7. A storage drawer system as set forth in claim 2, wherein: each of said support and upper walls of each support structure includes an inner edge disposed toward the other support structure and an outer portion further from the other support structure; and each of said support and upper bearings includes a base having an overlapping sliding fit with the outer portion of its corresponding wall and an interference fit with the inner edge of its corresponding wall.

8. A storage drawer system as set forth in claim 7, wherein: each of said support and additional bearings also includes a flexible finger which snap-fits into a mating fixture formed in its corresponding support structure.

* * * * *